US006003966A

United States Patent [19]

Ahn

[11] Patent Number: 6,003,966

[45] Date of Patent: Dec. 21, 1999

[54] DEVICE FOR SENSING CARTRIDGE REPLACEMENT TIME IN A PRINTER EQUIPMENT USING AN INKJET INJECTING APPARATUS

[75] Inventor: Byung-Sun Ahn, Kyungki-do, Rep. of Korea

[73] Assignee: SamSung Electronics Co., Ltd., Kyungki-do, Rep. of Korea

[21] Appl. No.: 08/807,230

[22] Filed: Feb. 28, 1997

[51] Int. Cl.[6] ..... B41J 2/195

[52] U.S. Cl. ..... 347/7

[58] Field of Search ..... 73/317, 321, 305; 340/623; 347/7, 85, 86, 87

[56] References Cited

U.S. PATENT DOCUMENTS

| | | | |
|---|---|---|---|
| 4,931,812 | 6/1990 | Dumn et al. | 347/87 |
| 4,977,413 | 12/1990 | Yamanaka et al. | 347/7 |
| 4,986,124 | 1/1991 | Bryrne et al. | 73/317 |
| 5,136,309 | 8/1992 | Lida et al. | 347/7 |
| 5,184,147 | 2/1993 | MacLane et al. | 347/30 |
| 5,280,299 | 1/1994 | Saikawa et al. | 347/87 |
| 5,280,300 | 1/1994 | Fong et al. | 347/87 |
| 5,363,130 | 11/1994 | Cowger et al. | 347/72 |
| 5,406,320 | 4/1995 | Durst et al. | 347/86 |
| 5,409,134 | 4/1995 | Cowger et al. | 222/1 |
| 5,414,452 | 5/1995 | Accatino et al. | 347/7 |
| 5,432,538 | 7/1995 | Carlotta | 347/30 |
| 5,434,603 | 7/1995 | Hunt | 347/7 |
| 5,552,815 | 9/1996 | Shimoda | 347/85 |
| 5,561,448 | 10/1996 | Kaneko et al. | 347/29 |
| 5,565,898 | 10/1996 | Sakuma | 347/23 |

*Primary Examiner*—John Barlow
*Assistant Examiner*—Charles W. Stewart, Jr.
*Attorney, Agent, or Firm*—Robert E. Bushnell, Esq.

[57] ABSTRACT

A cartridge having a storage reservoir for retaining printing ink in a printer equipment using an inkjet injection apparatus includes a device for sensing cartridge replacement time. The reservoir is to precisely sense the presence of the ink and to work with a device for sensing so as to accurately note a time for replacement of an ink cartridge. In such a device for sensing, when a conductor sensing plate descends along the surface of the ink within the storing part, the conductor sensing plate allows a sensing terminal and a conductor sensor to ground at the lowest level of the ink. Then, the sensing terminal connected to a sensor senses the presence of the ink to send a signal to a central processing unit, thereby accurately recognizing the replacement time of the cartridge.

18 Claims, 4 Drawing Sheets

DEVICE FOR SENSING CARTRIDGE REPLACEMENT TIME IN A PRINTER EQUIPMENT USING AN INKJET INJECTING APPARATUS

CLAIM OF PRIORITY

This application makes reference to, incorporates the same herein, and claims all benefits accruing under 35 U.S.C §119 from an application entitled Device For Sensing Cartridge Replacement Time in a Printer Equipment Using an Inkjet Injecting Apparatus earlier filed in the Korean Industrial Property Office on Nov. 13, 1995, and there duly assigned Serial No. 95-41018 by that Office.

BACKGROUND OF THE INVENTION

1. Field of the Invention

The present invention relates generally to a device for sensing cartridge replacement time in items of image forming equipment such as a printer or facsimile using an inkjet injecting apparatus, and, more particularly, to a process and device in which the quantity of ink within a cartridge that stores ink for performing a printing operation is sensed so as to ascertain the replacement time of the cartridge.

2. Description of Related Art

Typically, ink cartridges of a printer are replaced by separating an ink cartridge from a head part for injecting ink. Such systems use wholly replaceable and integrally-provided ink cartridges and head parts that fit such cartridges. Among the exemplars of the contemporary practice is Hunt (U.S. Pat. No. 5,434,603, Ink Cartridge With Passageway For Ink Level Indicator, Jul. 18, 1995) discussing an ink jet pen supply cartridge having a spring biased ink reservoir with a visual indication of remaining ink quantity. Durst et al. (U.S. Pat. No. 5,406,320, Ink Replacement Assemblies For Ink Jet Printer, Apr. 11, 1995) discusses an ink supply housing of an ink replenishment system including a pair of opposed side walls having a plurality of attachments spaced in respective opposing vertical columns and detachable detents coupled at one of the attachments. Shimoda (U.S. Pat. No. 5,552,815, Ink Jet Apparatus Including Means For Regulating An Amount Of Ink And An Amount Of Air In An Ink Tank Relative To Each Other, Sep. 3, 1996) discusses an ink jet apparatus having a head for forming an image picture on a recording paper, a subsidiary ink tank detachably coupled to the head for accommodating ink and air therein, and a cartridge on which the head and the subsidiary ink tank are mounted and used for scanning the recording region. Dunn et al. (U.S. Pat. No. 4,931,812, Flow Control System For Ink Cartridges, Jun. 5, 1990) discusses an ink cartridge system which includes a reservoir maintained at a negative pressure in communication with a printing system. MacLane et al. (U.S. Pat. No. 5,184,147, Ink Jet Print Head Maintenance System, Feb. 2, 1993) discusses an ink jet print head cleaning and maintenance system using a specialized baffle diverting ink that enters the purge chamber and discusses a vent port through in which the vacuum is drawn. From my study of the contemporary practice and the art, I find that there is a need for an effective device for sensing cartridge replacement time in a printer equipment using an inkjet injecting apparatus such as an inkjet printer or facsimile, especially those using a floating mechanism.

SUMMARY OF THE INVENTION

It is an object of the present invention to provide an improved process and device for sensing cartridge replacement time in a printer equipment using an inkjet injecting apparatus such as an inkjet printer or facsimile.

It is another object to provide an improved process and device in which the quantity of ink within a cartridge that stores ink for performing a printing operation is sensed so as to ascertain the replacement time of the cartridge.

It is another object of the present invention to provide a process and device for sensing cartridge replacement time, wherein the exhaustion of ink within a storing part of a cartridge is precisely sensed to allow for recognizing an accurate replacement time of the cartridge.

To achieve the above object of the present invention, a conductor sensing plate gradually descends within a storing part of a cartridge along the surface of the ink within the storing part. This contacts a sensing terminal connected to a sensor for recognizing the replacement time of the cartridge.

Accordingly, a device for sensing cartridge replacement time in a printer equipment using an inkjet injection apparatus includes an electrically conducting sensing plate having a floating body capable of being floated on the surface of ink. A tension spring draws the sensing plate toward an ink filter. A guide guides the up and down motion of the conductor sensing plate. Also, a sensing terminal is in contact with the conductor sensing plate. A sensor is connected to the sensing terminal for determining whether the sensing operation is carried out. A pressure maintenance unit prevents the drop of the internal pressure of the reservoir.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 7:
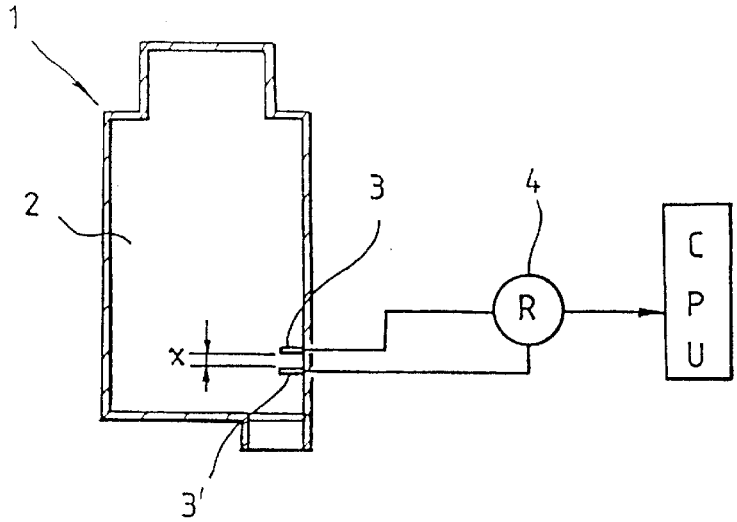
FIG. 7 is a diagrammatic sectional view showing a contemporary practice.

Turning now to the drawings, FIG. 7 shows a cross-sectional view of the ink cartridge separating system. As shown in FIG. 7, a device for sensing the ink replacement time is utilized such that two electrodes 3 and 3' onto the bottom surface of a reservoir 2 of ink cartridge 1 are separated from each other by a prescribed distance to be connected to a resistor 4. Thus, while the condition of the ink is sensed by using the resistance of the ink between both electrodes as a reference when there is ink present. When there is no ink present, the value of resistance between the electrodes is infinite. I have found that such an ink sensing unit that uses that system of electrode resistance may encounter great variations in the sensing of the quantity and the resistance. Also, an corrosion caused by a chemical reaction between the ink and electrode surface is induced to form an oxide layer over the surface of the electrode so that the electrodes become non-conductors to increase the resistance. This can cause a false indication of a lack of ink within reservoir 2—regardless of the presence of the ink therein. Thus, this produces a problem of a replacement time error of the ink cartridge and results in a dissipation by wasting the cartridge having the ink therein by replacing it. Since the integrated ink cartridge and head has no ink sensing device, a waste of "early-time" replacement or recharging by a user's misjudgment that the ink is used up is caused. This is regardless of the presence of ink—due to the fact of clogging an opening that injects the ink during using the printer equipment. In addition, if the ink cartridge is recharged in spite of the sufficient quantity of the internal ink, the ink externally overflows to contaminate hands, clothes and the inside of the equipment. Furthermore, regardless of the unavailable sensing state at the point of replacing the cartridge, data is successively received to continue the printing operation, thereby inciting problems of impeding perfect printing or reception of data.

FIGS. 1 through 6, inclusive illustrate another device for sensing cartridge replacement time; a device for sensing cartridge replacement time according to the present invention will be described in detail with reference to FIGS. 1 to 6.

Guides, or part of guide rails, 10 are provided to both internal sides of an ink storing part, or reservoir, 2 of a cartridge 1, and conductor sensing plates, or plate, 12 respectively have guide holes 11 inserted with guides 10—for being guided. Conductor sensing plate 12 ascends and descends up and down in accordance with guide 10. A sensing terminal, or terminals, 13 is installed to the lower end of guide 10. Also, once conductor sensing plate 12 descends to be in contact with sensing terminal 13, it transfers the contact motion to a sensor 14. Here, since sensing terminal 13 is to contact with a conductive substance, conductor sensing plate 12 may have a conductive property or a welding part, also referred to as a conductive element in the claims 12*b* of a conductive terminal 12*a* may be melted to be attached.

Conductor sensing plate 12 is equipped with a floating body, or floating element 15 to be floated upon the surface of ink 5 within storing part 2, and is installed with a tension spring 17 by using a fixing unit such as a spring hook 16 to the bottom portion thereof for exerting a downward drawing force from the upper portion to the lower portion. Tension spring 17 functions by allowing for precise descending motion to correspond to the water level of ink which is lowered in accordance with the exhaustion of ink 5 within storing part 2. A drawing force Fa of tension spring 17 is to be slightly smaller than a buoyancy F of floating body 15. Ink 5 within storing part 2 is gradually exhausted while being used. For this reason, when the internal pressure of storing part 2 is lowered, the injection is obstructed. Therefore, in order to prevent the drop of the internal pressure of storing part 2 and to maintain a constant pressure, a flexible pressure keeping tube, or expandable body, 18 is connected to an air hole 7 of a cap part 6. Pressure keeping tube 18 is inflated by receiving air via air hole 7 when ink 5 is used up to permit the internal pressure of storing part 2 to be the same as the atmospheric pressure, thereby smoothly performing the smooth injection supply of ink 5 into a nozzle part 9 which is provided with an ink filter 8.

Figure 1:
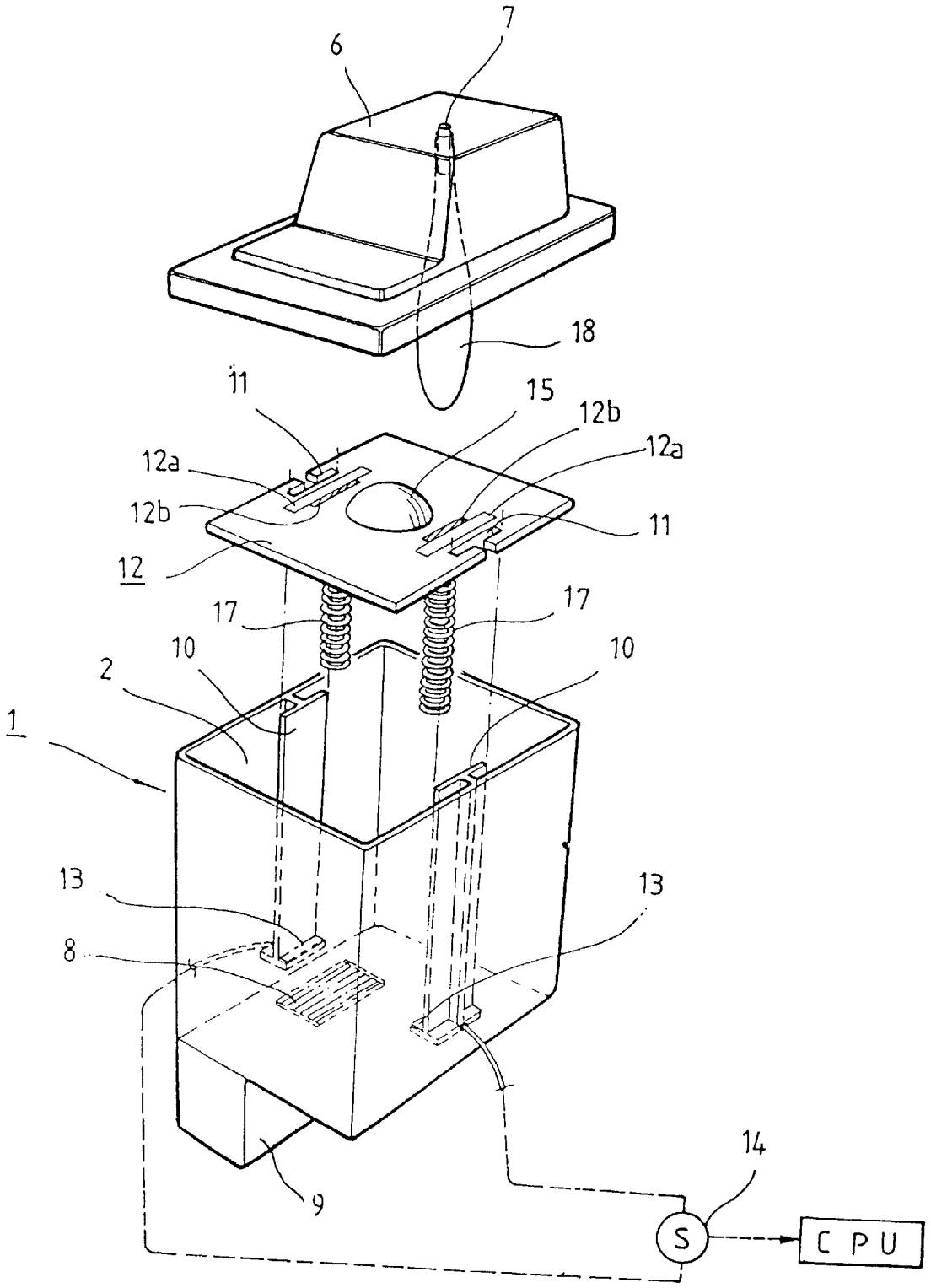
FIG. 1 is an exploded perspective view of a device constructed according to the principles of the present invention.
Figure 2:
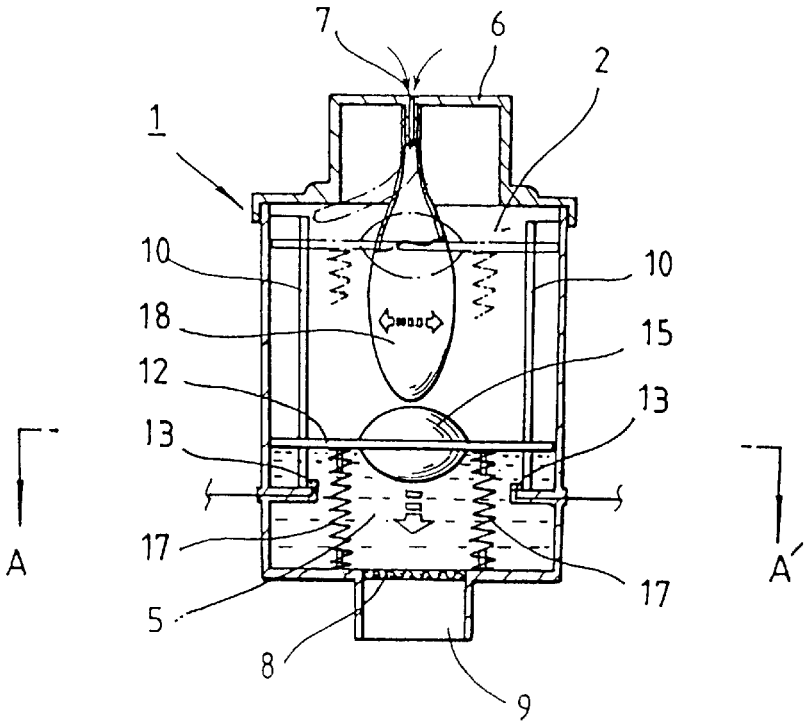
FIG. 2 is a vertical sectional view of a device constructed according to the principles of the present invention.

An operation of the present invention will be described in detail with reference to FIGS. 2 and 3. Under the state that ink 5 fills up storing part 2, conductor sensing plate 12 is floated onto the surface of ink 5 by a floating body 15. Thus, conductor sensing plate 12 is placed to the upper portion of storing part 2 as designated by a virtual line of FIG. 2. Consequently, when ink 5 is depleted while employing the printer, the water level of ink 5 is lowered as much as the exhausted quantity. At this time, since tension spring 17 draws on conductor sensing plate 12, conductor sensing plate 12 gradually descends while being guided by guide 10 together with the water level. Meanwhile, when the internal pressure of storing part 2 is dropped as ink 5 is exhausted, the external air is introduced via air hole 7 to inflate pressure keeping tube 18 to maintain the same pressure as the atmospheric pressure without changing the internal pressure.

Figure 3:
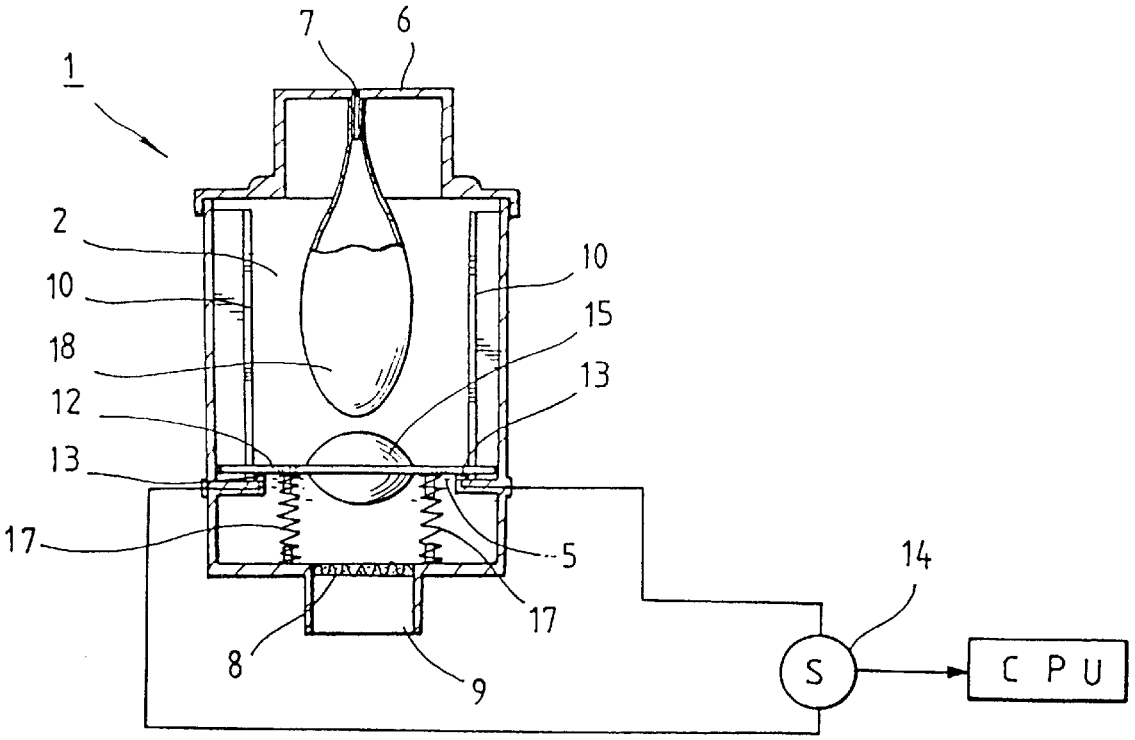
FIG. 3 is a sectional view showing an operation of sensing cartridge replacement time according to the present invention.

FIG. 3 shows the sensing state according to the present invention. Upon the reaching of a preset ink level of exhaustion, conductor sensing plate 12 becomes in contact with sensing terminal 13 to be grounded. By doing so, sensor 14 senses the contact state while signaling the lack of ink to a central processing unit CPU which then displays an instruction of supplementing the ink or exchanging cartridge 1 or stops the operation of an engine immediately or after printing prescribed sheets of paper. As a result, the cartridge replacement time is recognized in accordance with the sensing signal to replace the cartridge, and the cartridge is replaced under the state that the ink is completely used up to require the replacement, thereby inhibiting the ink waste which is heretofore caused by the untimely exchange of the cartridge. In case of a facsimile, perfect data can be obtained by the accurate sensing of the presence of ink within the cartridge, thereby enhancing the reliability of a product which involves no error in sensing the replacement time.

Figure 4:
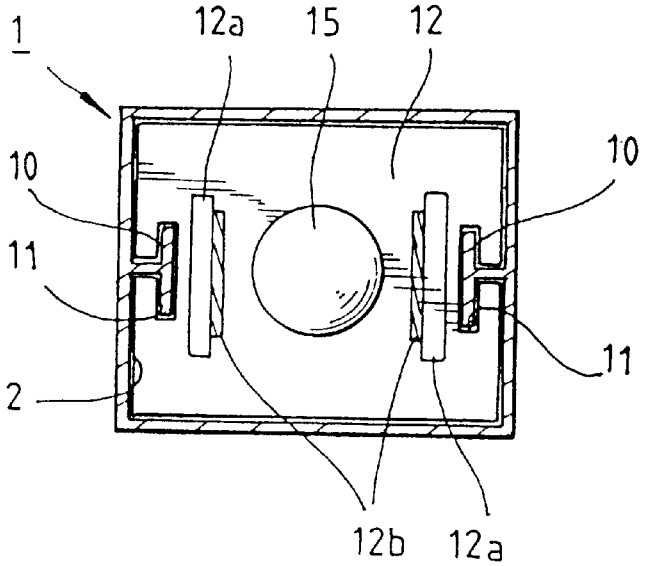
FIG. 4 is a sectional view taken along line A–A' of FIG. 2.

A cross-sectional view of the toner exhaustion detection device is shown in FIG. 4. Slots 11 allow pair of guide rails 10 to slidably engage plate 12. Conductive elements 12*b* and conductive terminals 12*a* allow the sensor (not shown) to determine when contact is made between terminals (not shown) that are located on the lower ends of pair of guide rails 10.

Figure 5:
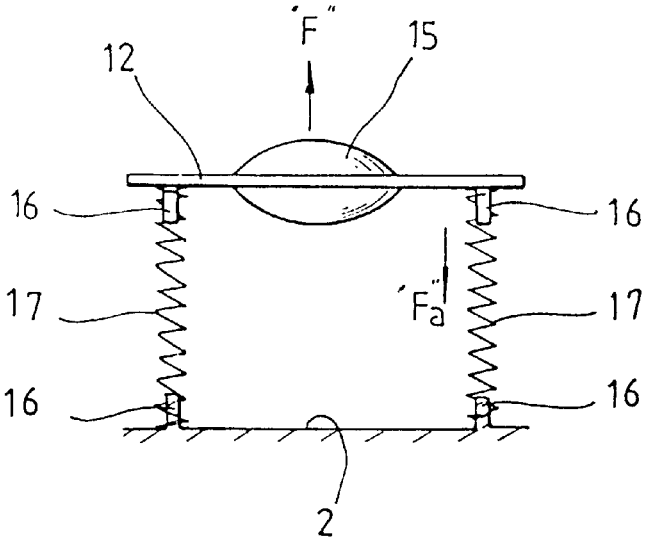
FIG. 5 is a view showing the relation between the conductive plate and tension spring according to the present invention.

FIG. 5 illustrates springs 17 connecting a lower side of plate 12, via plugs 16, to the bottom of reservoir 2. The springs exert a downward force 'Fa' on plate 12, that is countered by the buoyancy force 'F' of floating element 15. Springs 17 prevent plate 12 from becoming stuck on pair of guide rails 10 and not moving downward along with the surface level of ink in the reservoir. To prevent plate 12 from submerging below the surface of the toner in the cartridge, floating element 15 provides a slightly stronger force on plate 12.

Figure 6:
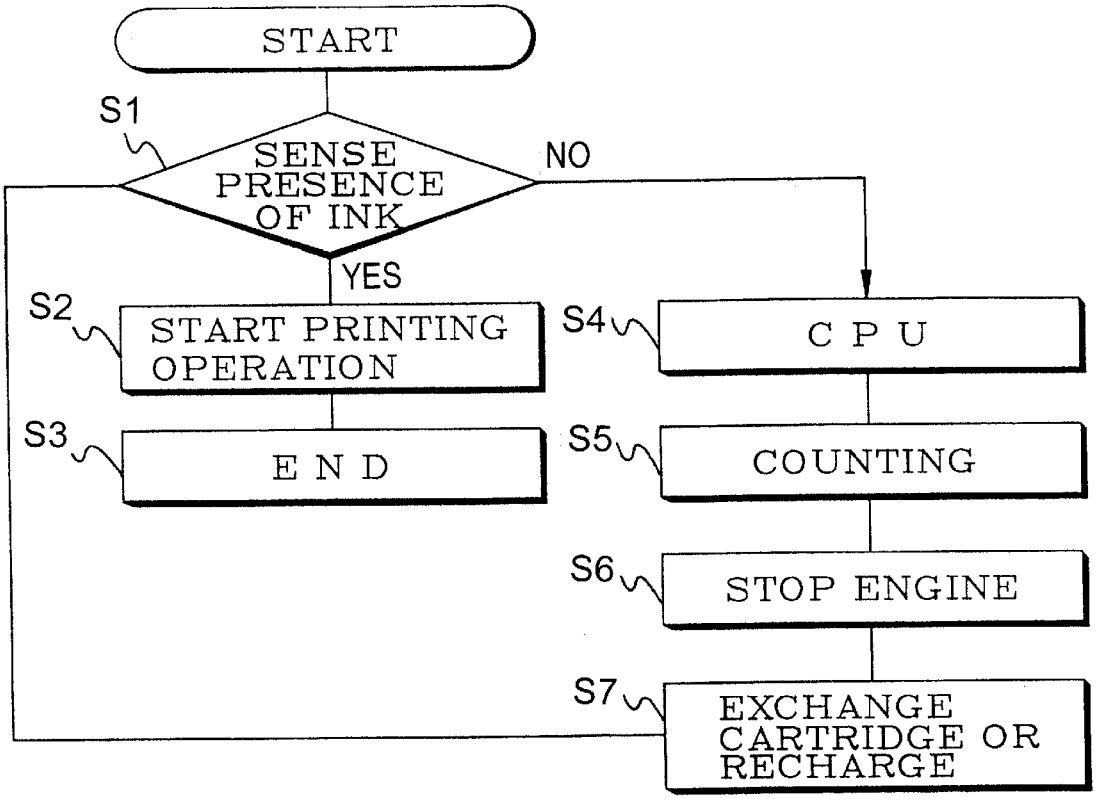
FIG. 6 shows a flowchart of the present invention.

The flowchart in FIG. 6 illustrates how the central processor continues to print until the above mentioned sensor determines that there is no more ink in the reservoir. When an exhaustion of ink is detected, the central processor stops the printer and alerts the user that it is time to replace the cartridge. This process for checking whether any ink remains in the cartridge is initiated when a print command is received by the central precessing unit. Then, in step 1, the central processor unit interprets data from the sensor to determine whether there is any ink remaining in the cartridge. If there is ink in the cartridge, then the printing operation is started during step 2. Once the printing is successfully completed, the printer stops, during step 3. If during step 1, the sensor unit detects an absence of ink in the cartridge, then a signal is sent to the central processing unit during step 4. Next, during step 5, the central processing unit delays, counts up to a certain number of seconds, and then stops the engine during step 6. Then a message or warning light notifies a user that the ink cartridge needs to be replaced during step 7.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A cartridge for an electrophotographic apparatus, comprising:

a body;

a reservoir contained in said body for storing a plurality of ink and having a pair of opposing side walls, said reservoir comprising:

a pair of guide rails disposed against said pair of opposing side walls; and a terminal attached at one end of each of said pair of guide rails; a plate slidably engaged with said pair of guide rails and comprising:

a floating element causing said plate to float on a surface of said ink in said reservoir; and a conductive element disposed to contact each of said pair of guide rails; and said plate contacting said one end of each of said pair of guide rails, while said ink is below a predetermined level, causing said conductive element to contact said terminal located on each of said pair of guide rails.

2. The cartridge of claim 1, wherein said plate has a plurality of slots for slidably engaging said pair of guide rails.

3. The cartridge of claim 1, further comprising a spring attached to both a lower side of the plate and a bottom side of said reservoir, said spring exerting a downward force on said plate.

4. The cartridge of claim 3, wherein a buoyancy of said floating element is greater than the downward force generated by said spring.

5. The cartridge of claim 1, further comprised of an expandable body attached to a bore in a top side of said body and protruding into said reservoir, said expandable body keeping a pressure inside said reservoir equal to another pressure outside of said body.

6. A cartridge for an electrophotographic apparatus, comprising:

a body having bearing a bore in a top side and ejecting a plurality of ink from a bottom side;

a reservoir contained in said body for storing said ink and having both a pair of opposing side walls and a bottom side, said reservoir comprising:

a pair of guide rails disposed against said pair of opposing side walls; and a terminal attached to each of said pair of guide rails;

a plate slidably engaged with said pair of guide rails and having a bottom surface, said plate comprising:

a floating element causing said plate to float on a surface of said ink in said reservoir; and a conductive element disposed to contact each of said pair of guide rails;

a spring attached to both said bottom surface of said plate and said bottom side of said reservoir; and said plate contacting said one end of each of said pair of guide rails, while said ink is below a predetermined level, causing said conductive element to contact said terminal located on each of said pair of guide rails.

7. The cartridge of claim 6, wherein said plate has a plurality of slots for slidably engaging said pair of guide rails.

8. The cartridge of claim 6, further comprising:

a sensor attached to said terminal on each of said pair of guide rails for determining a resistance between said terminal on each of said pair of guide rails; and a controller connected to said sensor for determining when said ink in said reservoir is below a predetermined level based on said resistance determined by said sensor.

9. The cartridge of claim 8, wherein a buoyancy of said floating element is greater than a force generated by said spring.

10. The cartridge of claim 6, further comprising an expandable body attached to said bore in said top side of said body and protruding into said reservoir, said expandable body being a balloon that maintains equality between a pressure inside of said reservoir and an atmospheric pressure outside of said body.

11. A cartridge, comprising:

a body;

a reservoir enclosed in said body for storing a plurality of ink and having a pair of opposing side walls, said reservoir comprising:

a pair of guide rails disposed against said pair of opposing side walls; and a terminal attached to each of said pair of guide rails; a plate slidably engaged with said pair of guide rails and comprising:

a floating element causing said plate to float on a surface of said ink in said reservoir; and a conductive element disposed to contact each of said pair of guide rails; and said plate contacting said one end of each of said pair of guide rails, while said ink is below a predetermined level, causing said conductive element to contact said terminal located on each of said pair of guide rails.

12. The cartridge of claim 11, wherein said plate has a plurality of slots for engaging said pair of guide rails.

13. The cartridge of claim 11, further comprising a spring attached to a lower side of said plate and to a bottom side of said reservoir.

14. The cartridge of claim 13, wherein the buoyancy of said floating element is greater than a force generated by said spring.

15. The apparatus of claim 11, further comprising an expandable body attached to a bore in a top side of said body and protruding into said reservoir, said expandable body keeping a pressure inside said reservoir equal to the atmospheric pressure surrounding the cartridge.

16. The cartridge of claim 13, further comprising:

said body bearing a bore in a top side and ejecting ink from a bottom side; and an expandable body attached to said bore and protruding into said reservoir, said expandable body keeping a pressure inside said reservoir equal to the pressure surrounding the cartridge.

17. The cartridge of claim 11, further comprising an ink filter attached to said reservoir.

18. The cartridge of claim 16, further comprising:

a sensor attached to said terminal on each of said pair of guide rails for determining a resistance between said terminal on each of said pair of guide rails; and a controller connected to said sensor for determining when said ink in said reservoir is below a predetermined level based on said resistance determined by said sensor.

* * * * *